US009604466B2

(12) United States Patent
Matsumoto

(10) Patent No.: US 9,604,466 B2
(45) Date of Patent: Mar. 28, 2017

(54) LIQUID-SUPPLY APPARATUS AND IMAGE-FORMING SYSTEM INCLUDING LIQUID-SUPPLY APPARATUS

(71) Applicant: Tetsuya Matsumoto, Ibaraki (JP)

(72) Inventor: Tetsuya Matsumoto, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/613,783

(22) Filed: Feb. 4, 2015

(65) Prior Publication Data

US 2015/0224775 A1 Aug. 13, 2015

(30) Foreign Application Priority Data

Feb. 10, 2014 (JP) ..... 2014-023546

(51) Int. Cl.
*B41J 2/175* (2006.01)
*B41J 2/18* (2006.01)
*B41J 29/38* (2006.01)

(52) U.S. Cl.
CPC ..... *B41J 2/17596* (2013.01); *B41J 2/175* (2013.01); *B41J 2/17503* (2013.01); *B41J 2/18* (2013.01); *B41J 29/38* (2013.01)

(58) Field of Classification Search
CPC ..... B41J 2/01; B05C 1/0813; B05C 1/083; B05C 1/0895
See application file for complete search history.

(56) References Cited

U.S. PATENT DOCUMENTS

2007/0035592 A1 2/2007 Oshio et al.
2013/0106946 A1* 5/2013 Sunaoshi ..... 347/21

FOREIGN PATENT DOCUMENTS

EP 2732974 A1 5/2014
JP 2007-50315 3/2007
JP 2014-100805 6/2014

* cited by examiner

*Primary Examiner* — Kristal Feggins
*Assistant Examiner* — Kendrick Liu
(74) *Attorney, Agent, or Firm* — Oblon, McClelland, Maier & Neustadt, L.L.P.

(57) ABSTRACT

A liquid-supply apparatus is disclosed. The apparatus supplies liquid to be applied onto a recording medium to a liquid-supply pan. The liquid-supply apparatus comprises a temporary-storage room arranged lower than a liquid surface of the liquid-supply pan, the temporary-storage room storing the liquid inside the liquid-supply pan by temporal evacuation, an evacuation line connecting the liquid-supply pan and the temporary-storage room, the evacuation line being a flow channel for the liquid during evacuation, an evacuation-line opening and closing member opening and closing the evacuation line, and a controller controlling an opening and closing operation of the evacuation-line opening and closing member. The liquid surface in the temporary-storage room is in a position lower than that of the liquid-supply pan. The controller controls the operation of the evacuation-line opening and closing member so as to fill the evacuation line with the liquid as an auxiliary operation just before the evacuation.

7 Claims, 12 Drawing Sheets

LIQUID-SUPPLY APPARATUS AND IMAGE-FORMING SYSTEM INCLUDING LIQUID-SUPPLY APPARATUS

CROSS-REFERENCE TO RELATED APPLICATIONS

The present application is based on and claims priority from Japanese Patent Application Number 2014-023546, filed Feb. 10, 2014, the disclosure of which is hereby incorporated by reference herein in its entirety.

BACKGROUND

The present invention relates to a liquid-supply apparatus and an image-forming system including the liquid-supply apparatus. In particular, the invention relates to an art to evacuate liquid inside a liquid-supply pan when the liquid is unnecessary.

An inkjet-recording apparatus such as a printer performs a process of applying pretreatment liquid (pretreatment) which condenses a color component of ink, in order to improve a print quality in relation to bleeding, density, color tone, show-through, and so on. The pretreatment liquid filled in the liquid-supply pan is deteriorated in an apparatus performing such a pre-application process. For example, such a pretreatment liquid is thickened or solidified thorough evaporation or contact with air. Japanese Patent Laid-open Application Publication No. 2007-050315 as Patent Document 1 discloses an art for solving such problems caused by the deterioration of the pretreatment liquid.

Patent Document 1 discloses a liquid application device in which a liquid-storage tank storing pretreatment liquid and a liquid-holding member attaching the pretreatment liquid onto a roller applying the pretreatment liquid onto paper are connected through a circulation line. The liquid application device executes a preliminary-circulation process before the liquid is applied to a recording medium of paper and so on so that the deteriorated thickening and the solid matter of the pretreatment liquid which remain in a ductwork are melted. Thereby, uneven application caused by the pretreatment liquid thickened in a flow channel or inhibition of the normal circulation can be prevented.

SUMMARY

The liquid-supply pan included in the liquid application device may be changed or removed by a user when printing is performed on one side surface only in an image-forming apparatus which is capable of replacing paper (changing of recording medium), changing the printing pattern, or performing double-side printing. In this instance, the pretreatment liquid is evacuated into a tank having a high sealing capacity in order to prevent the deterioration of the pretreatment liquid due to the exposure to air, compared with the case of a normal printing job (a unit of a job to be executed by a computer). The user cannot change/remove the liquid application device until the evacuation operation is completed, so a reduction of the time required for the evacuation operation of the pretreatment liquid is desired. Patent Document 1 does not consider such a problem.

To solve the above problems, it is an object of the present invention to provide a liquid-supply apparatus which can reduce the time for evacuating the liquid from the liquid-supply pan in which the liquid to be applied to the recording medium is stored, and to provide an image-forming system including the liquid-supply apparatus.

To achieve the above object, an aspect of the present invention provides a liquid-supply apparatus which supplies liquid to be applied onto a recording medium to a liquid-supply pan storing the liquid, the liquid-supply apparatus comprising a temporary-storage room arranged in a position lower than a liquid surface of the liquid-supply pan, the temporary-storage room storing the liquid inside the liquid-supply pan by temporal evacuation, an evacuation line connecting the liquid-supply pan and the temporary-storage room, the evacuation line being a flow channel for the liquid during evacuation, an evacuation-line opening and closing member opening and closing the evacuation line, and a controller controlling an opening and closing operation of the evacuation-line opening and closing member, wherein the liquid surface in the temporary-storage room is disposed in a position lower than a position of the liquid-supply pan, and the controller controls the opening and closing operation of the evacuation-line opening and closing member so as to fill the evacuation line with the liquid as an auxiliary operation just before the evacuation.

In addition, the image-forming system as an aspect of the present invention includes the liquid-supply apparatus, the liquid-supply pan, a liquid application device which applies the liquid onto the recording medium, and an image-forming apparatus which outputs the image-forming information toward the recording medium.

BRIEF DESCRIPTION OF THE DRAWINGS

The accompanying drawings are included to provide further understanding of the invention, and are incorporated in and constitute a part of this specification. The drawings illustrate Embodiment of the invention and, together with the specification, serve to explain the principle of the invention.

DETAILED DESCRIPTION OF THE PREFERRED EMBODIMENT

Figure 1:
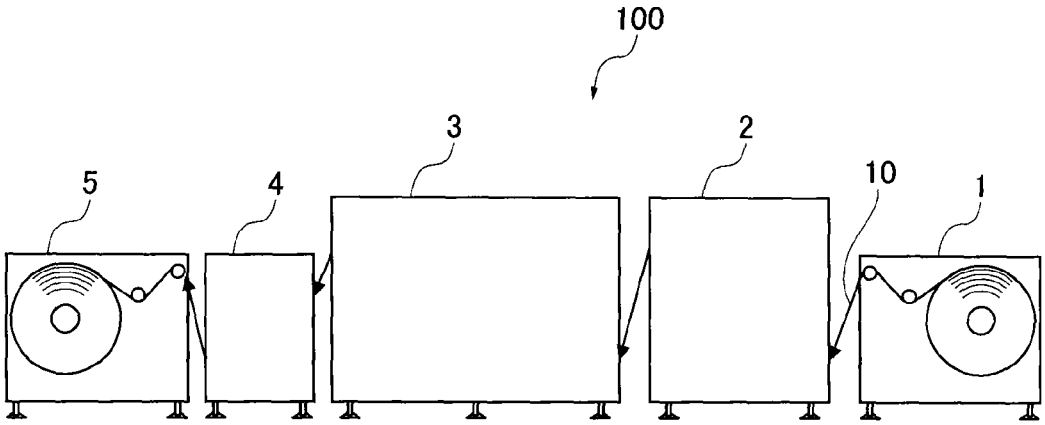
FIG. 1 is a view schematically illustrating a configuration of an image-forming system according to the present Embodiment.

Hereinafter, Embodiment of the present invention will be explained with reference to the drawings. In Embodiment, an example is shown in which an apparatus according to the present invention is applied to a liquid application device in a pretreatment device which is included in an image-forming system which performs an image formation process on continuous paper as a rolled recording medium. Firstly, an image-forming system according to Embodiment of the present invention will be described with reference to FIG. 1. FIG. 1 schematically illustrates a configuration of an image-forming system according to Embodiment.

Embodiment

An image-forming system 100 shown in FIG. 1 includes a paper-feeding device (unwinder) 1, a pretreatment device 2, an image-forming apparatus 3, an after-treatment device 4, and a rewinder 5.

Continuous paper 10 in a wound roll state is set in the paper-feeding device 1 and is ejected to the pretreatment device 2. The pretreatment device 2 applies pretreatment liquid to the continuous paper 10 and dries the pretreatment liquid in order to prevent bleeding or show-through of liquid ink adhered on the continuous paper 10 in the image-forming apparatus 3. The image-forming apparatus 3 outputs an image-formation signal to the recording medium 10 after the pretreatment process, and ejects the continuous paper 10. Thus, the continuous paper 10 is used as a recording medium of the image. The after-treatment device 4 performs an after-treatment on the continuous paper 10 ejected from the image-forming apparatus 3. The rewinder 5 winds the continuous paper 10 in a rolled state after the after-treatment. A tension is applied to the continuous paper 10 because the rewinder 5 winds the continuous paper 10 to be in a rolled state. Thus, the continuous paper 10 is fed toward the rewinder 5 from the paper-feeding device 1. Hereinafter, the feeding direction of the continuous paper 10 is represented as an upper stream on the side of the paper-feeding device 1, and is represented as a downstream on the side of the rewinder 5.

The paper-feeding device 1, the pretreatment device 2, the image-forming apparatus 3, the after-treatment device 4, and the rewinder 5 can be selected appropriately and the connection order of these can be changed according to the details of the printing process to be executed in the image-forming system 100. For example, when the after-treatment device 4 is configured as a device performing a bookbinding process, folding process, or cutting process, the rewinder 5 can be connected to the downstream of the image-forming apparatus 3, and the after-treatment device 4 can be connected to the downstream of the rewinder 5. In addition, when the pretreatment process is not required for the rolled continuous paper 10, or when the roll of the wound continuous paper 10 after the pretreatment process is set to the paper-feeding device 1, not the pretreatment device 2 but the image-forming apparatus 3 can be connected to the downstream of the paper-feeding device 1.

In Embodiment, a general process of the entire image-forming system 100 is performed by a controller included in the image-forming apparatus 3. Therefore, the paper-feeding device 1, the pretreatment device 2, the after-treatment device 4, and the rewinder 5 can be considered as external connection devices of the image-forming apparatus 3.

On the other hand, each of the paper-feeding device 1, pretreatment device 2, the image-forming apparatus 3, after-treatment device 4, and rewinder 5 includes an engine for executing a particular function of each device in addition to the configuration which is similar to an information-processing terminal, such as a general server and PC (Personal Computer). Thereby, each device executes each performance under the command from the image-forming apparatus 3, whereas executing the particular operation of each device.

Figure 2:
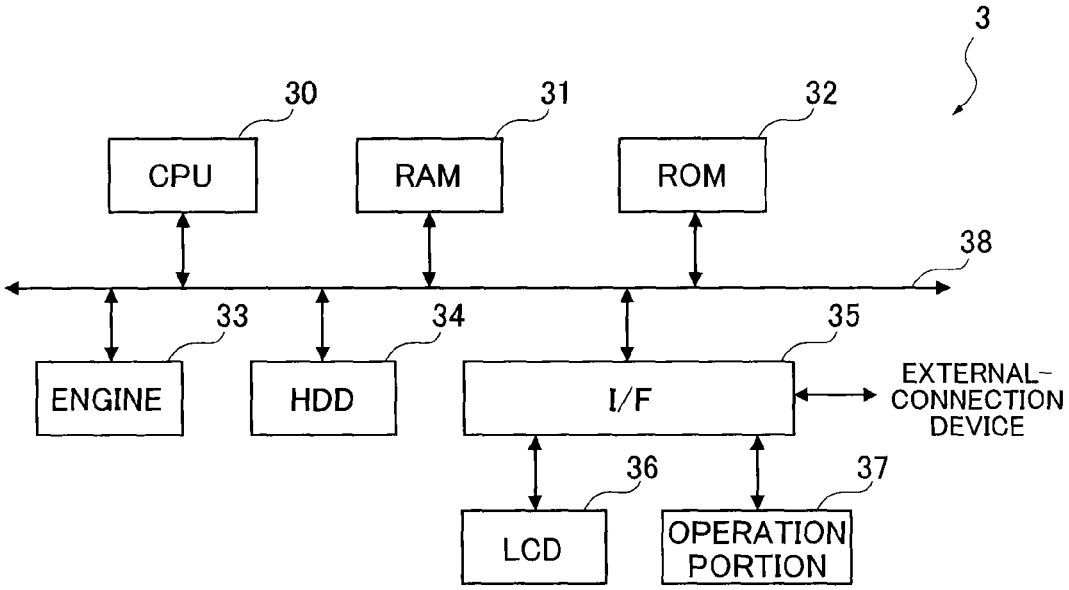
FIG. 2 is a block diagram illustrating a configuration of hardware of the image-forming apparatus shown in FIG. 1

Hereinafter, a configuration of hardware of the image-forming apparatus 3 which performs a general-control process of the image-forming system 100 will be described as an example with reference to FIG. 2. However, the paper-feeding device 1, the pretreatment device 2, the after-treatment device 4, and the rewinder 5 include a similar hardware configuration for each. FIG. 2 is a block diagram illustrating a hardware configuration of the image-forming apparatus shown in FIG. 1.

As shown in FIG. 2, the image-forming apparatus 3 according to Embodiment includes an engine for executing image formation in addition to the configuration which is similar to that of an information-processing terminal, such as a general server and PC (Personal Computer). That is, the image-forming apparatus 3 according to Embodiment includes a CPU (Central Processing Unit) 30, RAM (Random Access Memory) 31, ROM (ReA/D Only Memory) 32, engine 33, HDD (Hard Disk Drive) 34, and I/F 35 which are connected through a bus 38. An LCD (Liquid Crystal Display) 36 and an operation portion 37 are connected to the I/F 35. In addition, a signal sending/receiving operation with external-connection devices connected to the image-forming apparatus 3 is performed through the I/F 35.

The CPU 30 is a computing device and controls the entire operation of the image-forming apparatus 3. The RAM 31 is a volatile recording medium in which high-speed reading and writing of information can be achieved, and the RAM 31 is used as a working area when the CPU 30 processes the information. The ROM 32 is a non-volatile read-only recording medium, and a program of firmware and so on is stored therein. The engine 33 is a unit which performs image forming in the image-forming apparatus 3.

The HDD 34 is an information readable/writable non-volatile recording medium and an OS (Operating System) and various types of control programs, an application program, and so on are stored in the HDD 34. The I/F 35 connects and controls the bus 38 and each hardware, network, and so on. The LCD 36 is a visual user interface for a user to confirm the condition of the image-forming system 100. The operation portion 37 is a user interface such as a keyboard and mouse in order to input information into the image-forming system 100.

In such a hardware configuration, a software controller is configured such that the program stored in the ROM32, HDD 34, not-shown optical disk, or so on is read by the RAM 31 and operated in accordance with the control by the CPU 30. A function block which realizes the function of the image-forming apparatus 3 is configured by a combination between the software configured as above and the hardware.

Figure 3:
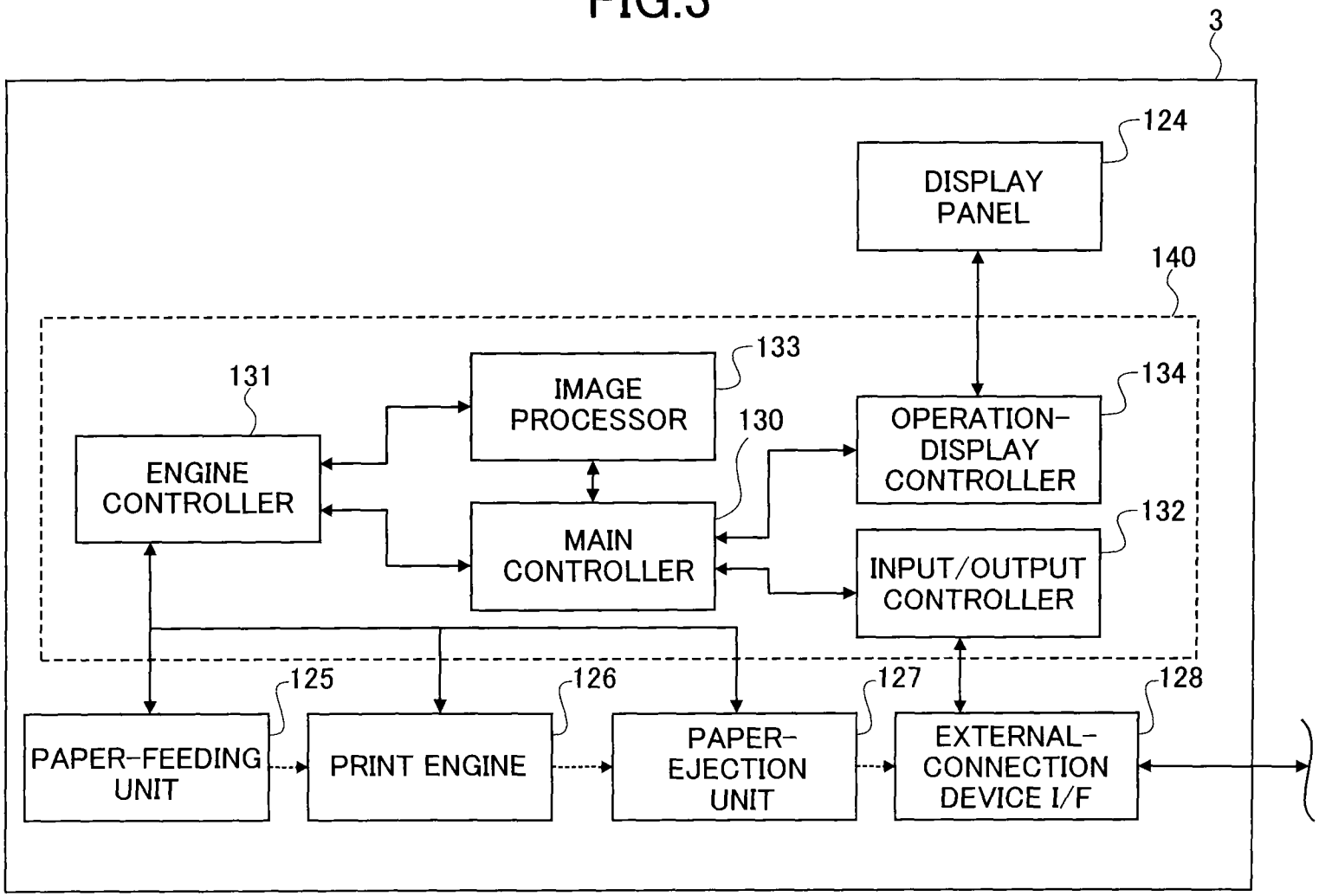
FIG. 3 is a block diagram illustrating a functional configuration of the image-forming apparatus shown in FIG. 1.

Next, with reference to FIG. 3, a function and configuration of the image-forming apparatus according to Embodiment will be described. FIG. 3 is a block diagram illustrating the function and configuration of the image-forming apparatus. As shown in FIG. 3, the image-forming apparatus 3 includes a controller 140, a display panel 124, a paper-feeding unit 125, a print engine 126, a paper-ejection unit 127, and an external-connection device I/F 128.

The controller 140 includes a main controller 130, an engine controller 131, an input/output controller 132, an image processor 133, and an operation-display controller 134. Herein, an electrical connection is illustrated by an arrow, and a flow of the paper is illustrated by a broken-line arrow in FIG. 3.

The display panel 124 is an output interface which visually displays a condition of the image-forming apparatus 3. At the same time, the display panel 124 works as an input interface (operation portion) when the image-forming system 100 is operated directly by a user as a touch panel or when information is input to the image-forming apparatus 3. The external-connection device I/F 128 is an interface to be used in communication with an external device through a network or a connection cable between devices. An Ethernet (Registered Trademark) or USB (Universal Serial Bus) interface is used as the external-connection device I/F 128.

The controller 140 is configured by a combination between the software and the hardware. Particularly, a control program of the firmware and so on stored in a non-volatile recording medium, such as the ROM 32, non-volatile memory as well as the HDD 34, the optical disk is loaded into the volatile memory (hereinafter, referred to as memory) as an example of the non-volatile recording medium. The controller 140 is configured by a software controller configured in accordance with the control of the CPU 30 and hardware such as an integrated circuit. The controller 140 operates as a controller which controls the image-forming system 100 as a whole.

The main controller 130 controls each portion included in the controller 140 and sends commands to each portion. The engine controller 131 operates as a driver which controls or drives the print engine 126.

The input/output controller 132 inputs to the main controller 130 the signal or command input through the external-connection device I/F 128. In addition, the main controller 130 controls the input/output controller 132 and accesses the other devices (paper-feeding device 1, pretreatment device 2, after-treatment device 4, rewinder 5, and not-shown printing job transmitter) through the external-connection device I/F 128.

The image processor 133 generates plotting information in accordance with printing information included in the input printing job according to the control by the main controller 130. The plotting information corresponds to information for plotting the image to be formed by the print engine 126 as the image-forming portion during the image-forming operation. In addition, the printing information included in the printing job corresponds to the image information which is converted by the printer driver installed in an information processor such as a PC to have a form which is capable of being recognized by the image-forming system 100. The operation-display controller 134 displays the information on the display panel 124 or notifies the information input through the display panel 124 to the main controller 130.

The input/output controller 132 receives the printing job through the external-connection device I/F 128 in the image-forming system 100. The input and output controller 132 transfers the received printing job to the main controller 130. The main controller 130 controls the image processor 133 when receiving the printing job so as to generate the plotting information according to the printing information included in the printing job.

After the plotting information is generated by the image processor 133, the engine controller 131 executes the image formation on the paper fed from the paper-feeding unit 125 in accordance with the generated plotting information. That is, the print engine 126 functions as an image-forming portion. The document on which the image formation is executed by the print engine 126 is ejected by the paper-ejection unit 127.

Figure 4:
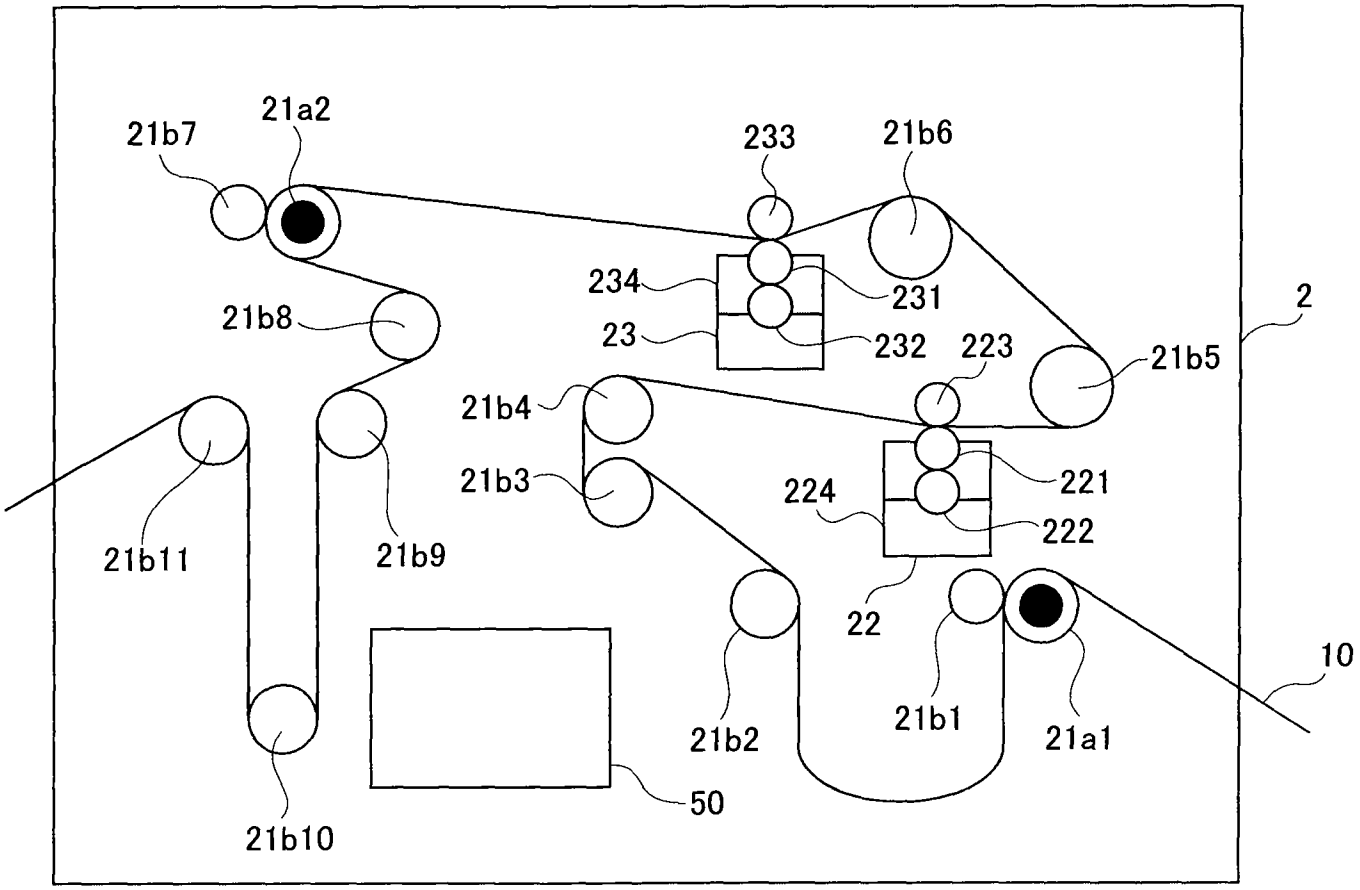
FIG. 4 is an explanatory view illustrating an inside configuration of a pretreatment device shown in FIG. 1.

Next, with reference to FIG. 4, an outline of the pretreatment device 2 will be described. FIG. 4 is an explanatory view illustrating the internal configuration of the pretreatment device shown in FIG. 1. As shown in FIG. 4, the pretreatment device 2 includes an upper-side surface application device 22 applying on an upper-side surface of the continuous paper 10 a liquid used in the pretreatment so as to accelerate the agglomeration of the ink (hereinafter, referred to as pretreatment liquid), a back-side surface application device 23 applying the pretreatment liquid on the back-side surface of the continuous paper 10, and a liquid-supply apparatus 50 which fills both of the upper-side surface application device 22 and the back-side surface application device 23 with the pretreatment liquid at the same time as evacuating the pretreatment liquid when the application operation is not performed. A feeding line of the continuous paper 10 in the pretreatment device 2 is formed by a feeding device including a plurality of feeding rollers.

The feeding roller includes two driving rollers **21*a*1 and 21*a*2, driven rollers 21*b*1 to 21*b*11 which contact the continuous paper 10 and rotate in the feeding direction of the continuous paper 10, and a drive assembly (not shown) which drives and rotates the driving rollers. These driving rollers configure the feeding path in the pretreatment device 2. The continuous paper 10 is fed on the feeding line from the paper-feeding device 1 to the image-forming apparatus 3. The upper-side surface application device 22 is arranged on the upstream side of the feeding line and the back-side surface application device 23** is arranged on the downstream side of the feeding line.

The upper-side surface application device 22 is configured by a cylindrical application roller 221, a squeeze roller 222 which makes the pretreatment liquid to be a thin film and transfers it onto the application roller 221, a pressure roller 223 which sandwiches the continuous paper 10 to apply pressure with the application roller 221, and a liquid-supply pan 224 which holds the pretreatment liquid under the squeeze roller 222 (liquid-supply pan is referred to as a supply pan). The squeeze roller 222 makes contact with the pretreatment liquid inside the supply pan 224.

After the pretreatment liquid is applied on the upper-side surface of the continuous paper 10 by the upper-side surface application device 22, the pretreatment liquid is applied on the back-side surface of the continuous paper 10 by the back-side surface application device 23 which is arranged on the feeding path.

The configuration of the back-side surface application device 23 is similar to the upper-side surface application device 22. The back-side surface application device 23 includes an application roller 231, a squeeze roller 232, a pressure roller 233, and a supply pan 234 (back-side surface supply pan). The upper-side surface application device 22 and the back-side surface application device 23 are detachable from the pretreatment device 2 so that they can be changed to an application device which is suitable for each printing paper and so on.

Each of the upper-side surface application device 22 and the back-side surface application device 23 is connected to the liquid-supply apparatus 50.

Figure 5:
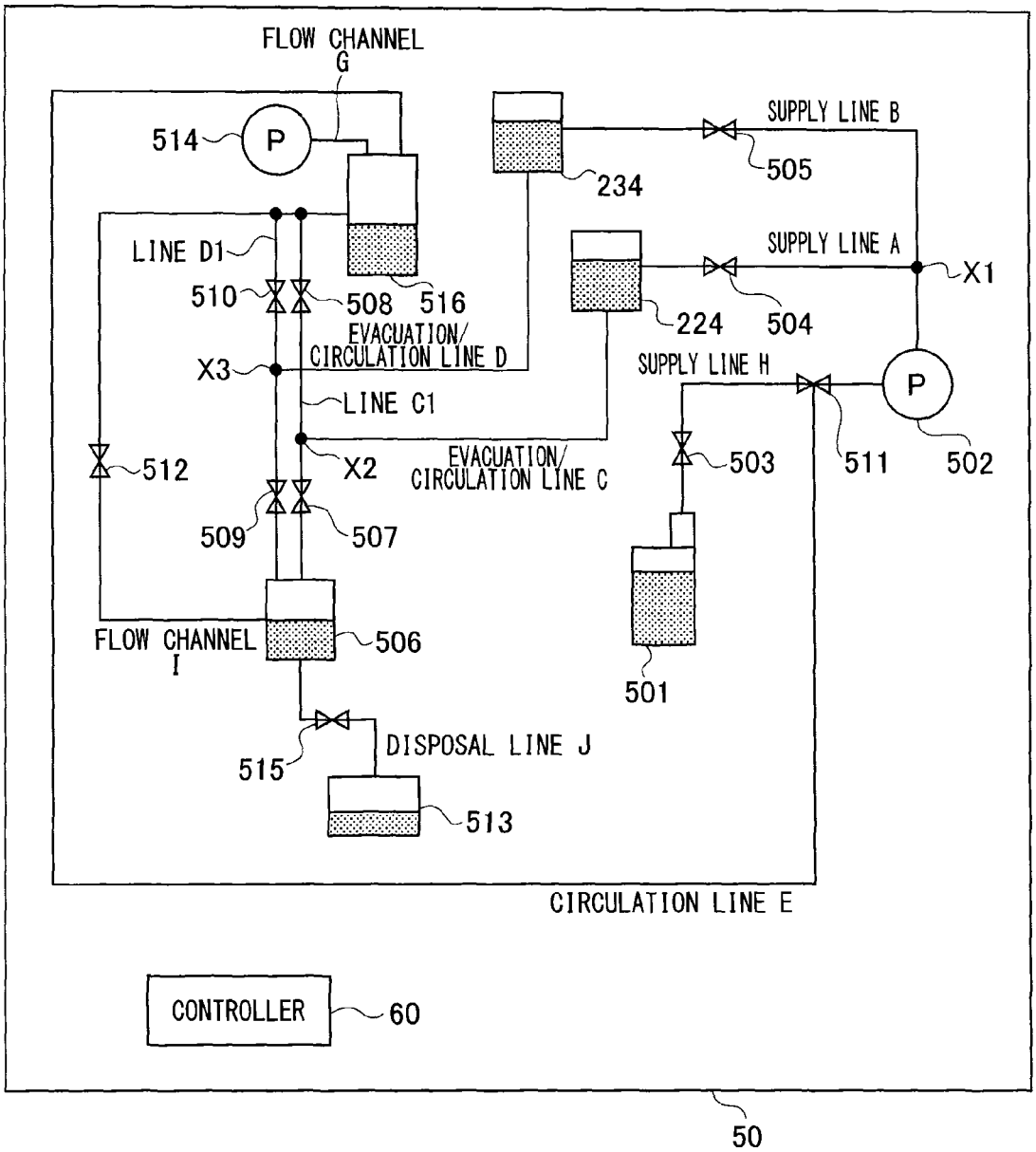
FIG. 5 is a view schematically illustrating a configuration of a liquid-supply apparatus.

Next, a description of the liquid-supply apparatus 50 will be made with reference to FIG. 5. FIG. 5 illustrates the schematic configuration of the liquid-supply apparatus. The liquid-supply apparatus 50 includes a pretreatment-liquid cartridge (hereinafter, referred to as a cartridge) 501 for filling up, a liquid-delivery pump 502 (liquid-flow generator) sending the pretreatment liquid to the supply pans 224 and 234 as a configuration for supplying the pretreatment liquid to the supply pan 224 of the upper-side surface application device 22 and the supply pan 234 of the back-side surface application device 23. The liquid-delivery pump 502 is arranged in between the cartridge 501 and the supply pans 224, 234.

The cartridge 501 and the liquid-delivery pump 502 are connected through a supply line H as a flow channel for the pretreatment liquid. An electromagnetic valve 503 is arranged on the supply line H so as to open and close the supply line H.

In addition, the liquid-supply apparatus 50 includes a supply line A from the liquid-delivery pump 502 to the supply pan 224 as the flow channel for the pretreatment liquid, and a supply line B which diverges from a branch point X1 on the supply line A as the flow channel for the pretreatment liquid which is sent to the supply pan 234. An electromagnetic valve 504 is arranged between the branch point X1 on the supply line A and the supply pan 224 so as to open and close the supply line A. An electromagnetic valve 505 is arranged on the supply line B so as to open and close the supply line B.

In addition, the liquid-supply apparatus 50 includes a reserve tank 506 temporally storing the pretreatment liquid (temporary-storage room), and a filtering chamber 516 for removing foreign material in the pretreatment liquid by circulating the pretreatment liquid in the supply pans 224 and 234 during an application operation. A not-shown remaining amount sensor is arranged in the reserve tank 506 so as to detect the remaining amount of the pretreatment liquid in the reserve tank 506. In addition, each of the supply pans 224 and 234 includes a low-level liquid surface-detecting sensor which detects whether or not the remaining amount of the liquid in the supply pans 224 and 234, in particular, the height of the liquid surface from each bottom surface of each supply pan as a base exceeds the lower limit. The pretreatment liquid in the supply pans 224 and 234 is transferred to the reserve tank 506.

The reserve tank 506 is configured to have an airtight configuration higher than that of the up-side surface supply pan 224 and the back-side supply pan 234. The reserve tank 506 is arranged so that the liquid surface inside thereof locates in a position lower than the bottom surfaces of the surface supply pan 224 and the back-side supply pan 234. That is, the reserve tank 506 is arranged so as to generate a water head difference between the liquid inside the reserve tank 506 and the liquid inside the surface supply pan 224 and the back-side supply pan 234.

The reserve tank 506 and the supply pan 224 of the upper-side surface application device 22 are connected through an evacuation and circulation line C. The evacuation and circulation line C functions as an upper-side surface evacuation line arranged so as to transfer a pre-application agent from the upper-side surface application device 22 to the reserve tank 506 during the evacuating operation.

A branch point X2 is arranged on the evacuation and circulation line C. The branch point X2 and the filtering chamber 516 are connected through a line C1 (line for filter). An electromagnetic valve 507 is arranged on the evacuation and circulation line C between the branch point X2 and the reserve tank 506. The line C1 functions as a flow channel for discharging air in the evacuation and circulation line C toward the filtering chamber 516 when the evacuation and circulation line C is filled with the liquid. An electromagnetic valve 508 is arranged on the line C1 so as to open and close the line C1.

Similar to the supply pan 224 in the upper-side surface application device 22, the supply pan 234 of the back-side surface application device 23 and the reserve tank 506 are connected with each other. That is, the reserve tank 506 and the supply pan 234 of the back-side surface application device 23 are connected through an evacuation and circulation line D. The evacuation and circulation line D functions as a back-side evacuation line arranged so as to transfer the pre-application agent from the back-side surface application device 23 to the reserve tank 506.

In addition, a branch point X3 is arranged on the evacuation and circulation line D. The branch point X3 and the filtering chamber 516 are connected through a line D1 (line for filter). An electromagnetic valve 509 is arranged between the reserve tank 506 and the branch point X3 on the evacuation and circulation line D so as to open and close the evacuation line on the reserve tank side on the evacuation and circulation line D (opening and closing member for back-side evacuation line). The line D1 functions as a flow channel arranged so as to discharge air in the evacuation and circulation line D to the filtering chamber 516 when the evacuation and circulation path D is filled with the liquid. An electromagnetic valve 510 is arranged on the path D1 so as to open and close the path D1.

The filtering chamber 516 and the reserve tank 506 are connected through a flow channel I. The flow channel I functions as a flow channel arranged so as to send the liquid inside the reserve tank 506 into the filtering chamber 516. An electromagnetic valve 512 is arranged on the flow channel I so as to open and close the flow channel I.

The filtering chamber 516 and the supply line H are connected through a circulation line E (a part of upper-side surface circulation line and back-side circulation line). An electromagnetic valve 511 configured by a three-way valve is provided in a connection portion between the supply line H and the line E. When the electromagnetic valve 511 opens, the supply line H connecting the liquid-delivery pump 502 and the cartridge 501 is opened. When the electromagnetic valve 511 closes, the circulation line E connecting the liquid-delivery pump 502 and the filtering chamber 516 is opened.

An exhaust pump 514 is connected to the filtering chamber 516 through a flow channel G and is used so as to keep the air pressure inside the filter constant.

In addition, the filtering chamber 516 and the reserve tank 506 are connected through the flow channel I of the pretreatment liquid. An electromagnetic valve 512 is arranged on the flow channel I so as to open and close the flow channel I. When the electromagnetic valve 512 opens, the pretreatment liquid in the reserve tank 506 flows into the filtering chamber 516. Through the circulation line E, supply lines H, A, or B from the filtering chamber 516, the filtered pretreatment liquid flows into the supply pans 224 and 234. Next, the circulation line for the pretreatment liquid after passing through the filtering chamber 516 is formed due to the pretreatment liquid flowing into the reserve tank 506 through the evacuation and circulation lines C or D from the supply pans 224 and 234. The filtering process can be performed several times by circulating the pretreatment liquid, thus removal of a foreign object in the pretreatment liquid can be performed with high accuracy.

In addition, the liquid-supply apparatus 50 includes a liquid-waste tank 513 for disposing the pretreatment liquid, a disposal line J from the reserve tank 506 to the liquid-waste tank 513, and an electromagnetic valve 515 opening and closing the disposal line J. When the electromagnetic valve 515 opens, the pretreatment liquid inside the reserve tank 506 flows into the liquid-waste tank 513. When the filtering process is insufficient after performing the above-described filtering process several times and it is determined that the disposal may be appropriate, the disposal process is performed by opening the electromagnetic valve 515. Thereafter, the electromagnetic valve 515 is closed.

In addition, the liquid-supply apparatus 50 includes a controller 60 which controls the opening and closing operation of the electromagnetic valve, the operation of the liquid-delivery pump 502, and the operation of the exhaust pump 514. The controller 60 is electrically connected to each electromagnetic valve, liquid-delivery pump 502, and so on, which are configured as the object of the control by the controller 60. The electrical connection of the controller 60 is not shown in FIG. 5 in order to simplify the description.

Figure 6:
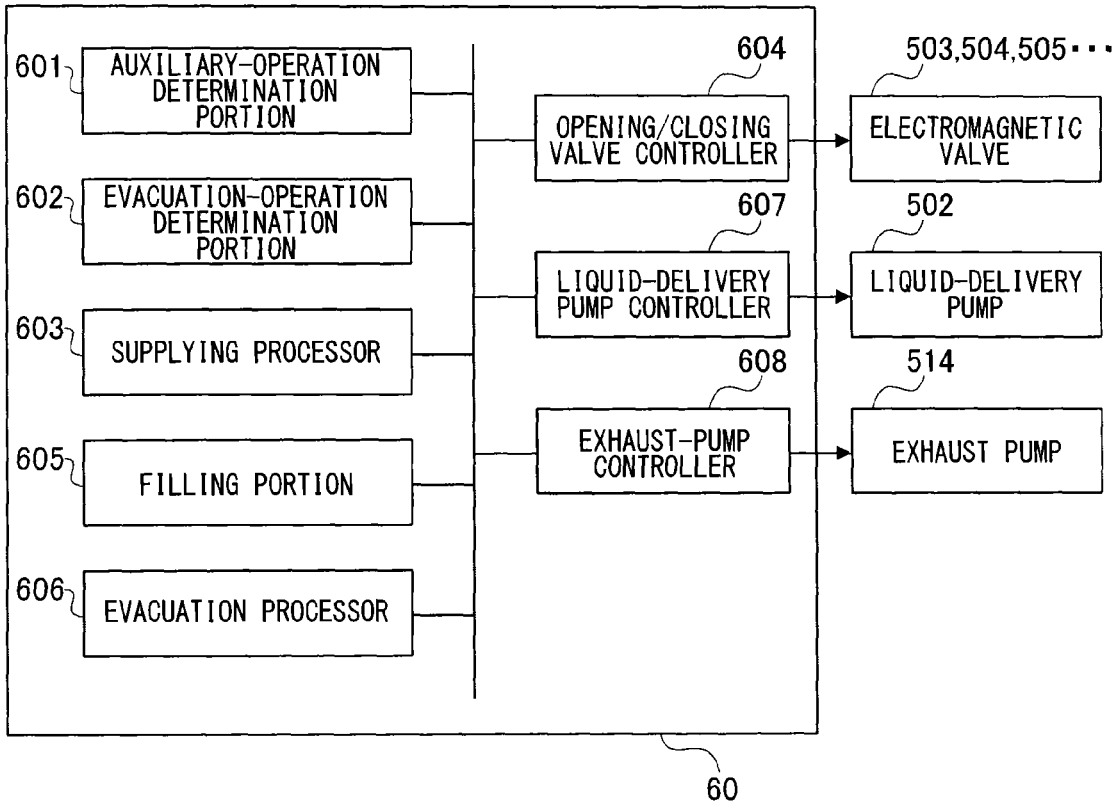
FIG. 6 is a block diagram illustrating a functional configuration of a controller.

Next, a configuration of the controller 60 will be described with reference to FIG. 6. FIG. 6 is a block diagram illustrating a functional configuration of the controller 60.

The controller 60 includes an auxiliary-operation determination portion 601 which determines whether or not to execute an auxiliary operation which fills up the evacuation and circulation lines C and D with the pretreatment liquid to the upper-side surface application device 22 and the back-side surface application device 23 prior to the evacuation operation of the pretreatment liquid, an evacuation-operation determination portion 602 which determines whether or not to execute the evacuation operation to the upper-side surface application device 22 and the back-side surface application device 23, a supplying processor 603 which performs the supplying operation of the pretreatment liquid to the upper-side surface application device 22 and the back-side surface application device 23, an opening and closing valve controller 604 (controller for opening and closing member) which controls the opening and closing operation of each electromagnetic valve, a filling portion 605 which performs a process of the filling the evacuation and circulation lines C and D with the pretreatment liquid, an evacuation processor 606 which performs the evacuation operation, a liquid-delivery pump controller 607 which controls the operation of the liquid-delivery pump 502, and an exhaust-pump controller 608 which controls the operation of the exhaust pump 514. Those components configuring the controller 60 are configured by the hardware shown in FIG. 2 together with software for realizing each function of those components.

The supply pans 224 and 234 are formed to cover the most part of application rollers 221 and 231 in the liquid-supply apparatus 50 so as to prevent the deterioration of the pretreatment liquid caused by the evaporation and the exposure to air. However, the perfectly closed system is not adopted in the liquid-supply apparatus 50 because it is necessary to open the pressure-welding portion of the application rollers 221, 231 and the pressure rollers 223, 233.

Therefore, the reserve tank 506 is arranged to have higher airtightness than those of the supply pans 224 and 234. When the electromagnetic valves 507 and 509 in the evacuation and circulation line C and evacuation and circulation line D which communicate with each supply pan 224, 234 and the reserve tank 506 are opened, the pretreatment liquid in the supply pans 224 and 234 are evacuated to the reserve tank 506 by the water-head difference. In this regard, the reserve tank 506, the upper-side surface application device 22, and the back-side surface application device 23 are arranged in the liquid-supply apparatus 50 so that the supply pans 224 and 234 are located in a position higher than the position of the liquid surface inside the reserve tank 506.

Generally, there are two execution timings of the evacuation operation which evacuates the pretreatment liquid from the supply pans 224 and 234 to the reserve tank 506. One is therefore when the stopping time of the application operation is longer than a predetermined threshold time, for example, at the time of turning off a power source, the time of changing paper (upon command of changing recording medium), and the time of changing a printing pattern (command of changing image-formation output state). The threshold time herein represents a time which can be considered to be longer than a time between ordinary jobs. The other one is therefore when the time of changing at least one of the upper-side surface application device 22 and the back-side surface application device 23, or when the evacuation operation is performed in order to detach the upper-side surface application device 22 or the back-side surface application device 23 from the pretreatment device 2. An operator cannot perform the next operation during both execution timings until the evacuation operation of the pretreatment liquid is terminated, but in the latter case, that is, upon the change/detach operation of the upper-side surface application device 22 or the back-side surface application device 23, the time in which the operator waits for the termination of the evacuation operation directly influences the throughput of the change/detach operation. Therefore, it is desired to shorten the evacuation time of the pretreatment liquid.

Herein, when the pretreatment liquid is transferred with use of the water-head difference according to Embodiment, the flowing speed of the pretreatment liquid in which the evacuation operation becomes low if the air resistance is strong on the evacuation line. Thus, the required time for the evacuation operation becomes longer. For example, in the case in which the length of the ductwork of the evacuation and circulation line D from the back-side surface application device 23 to the reserve tank 506 is 2 m, the length of the ductwork of the evacuation and circulation line C from the upper-side surface application device 22 to the reserve tank 506 is 1 m, the diameter of the ductwork is 7 y, and the output of the pump is about 500 ml/min, the total required time is about several ten seconds under the condition in which each ductwork is filled with air. However, when the ductwork of the evacuation and circulation lines C and D is completely filled with the pretreatment liquid, the flowing speed of the pretreatment liquid upon the evacuation operation with use of the water-head difference rises because the air resistance is disappeared. Therefore, the evacuation time can be reduced to be the half or less of the several minutes which is required in the conventional case. In the evacuation operation of the pretreatment liquid with use of the water-head difference according to Embodiment, it is important that the ductwork as the evacuation line is preliminary filled with the pretreatment liquid without generating the air resistance so as to improve the evacuation speed.

Figure 7:
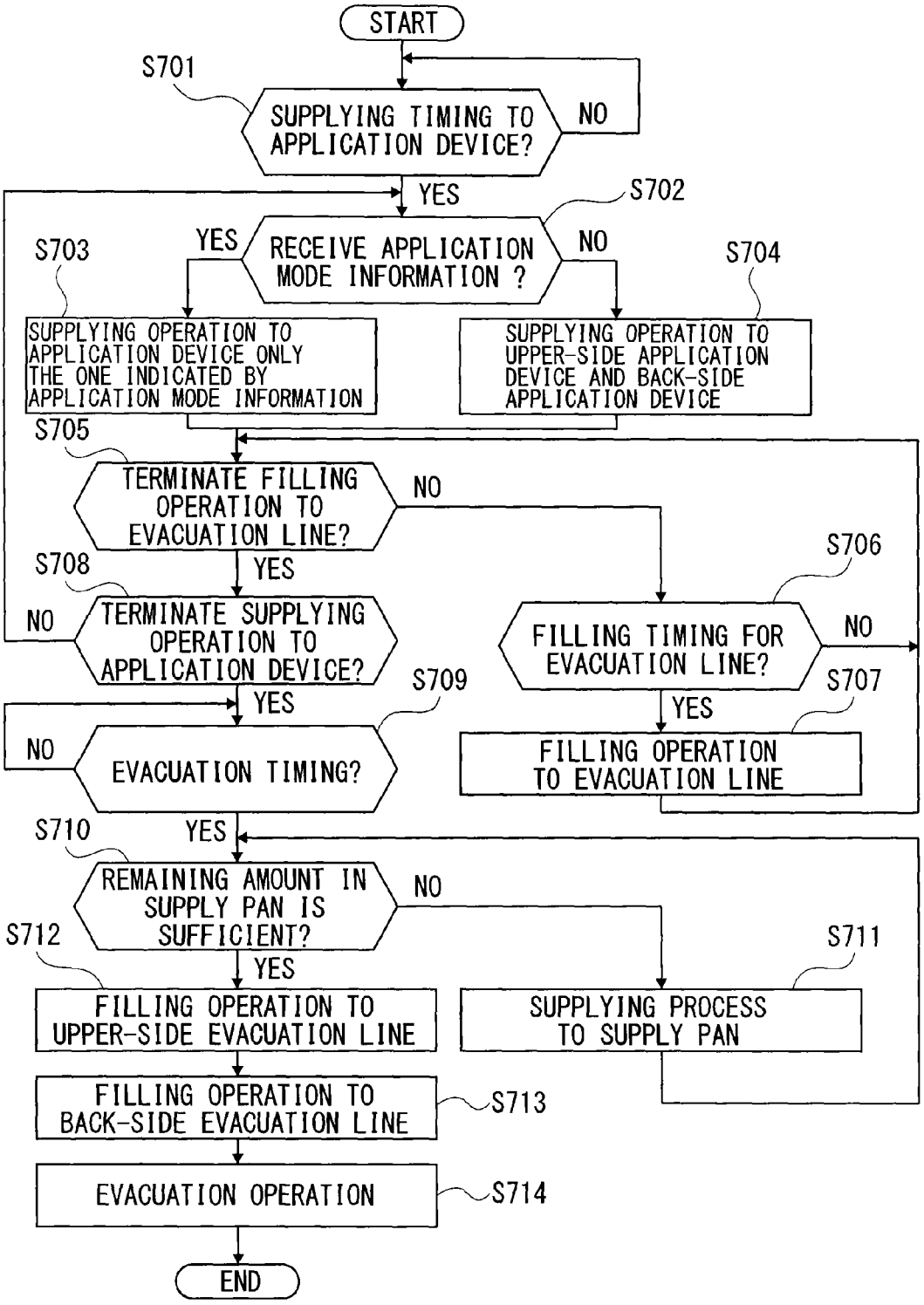
FIG. 7 is a flow chart illustrating a flow of a process performed by the pretreatment device which includes the liquid-supply apparatus according to the present Embodiment.
Figure 8:
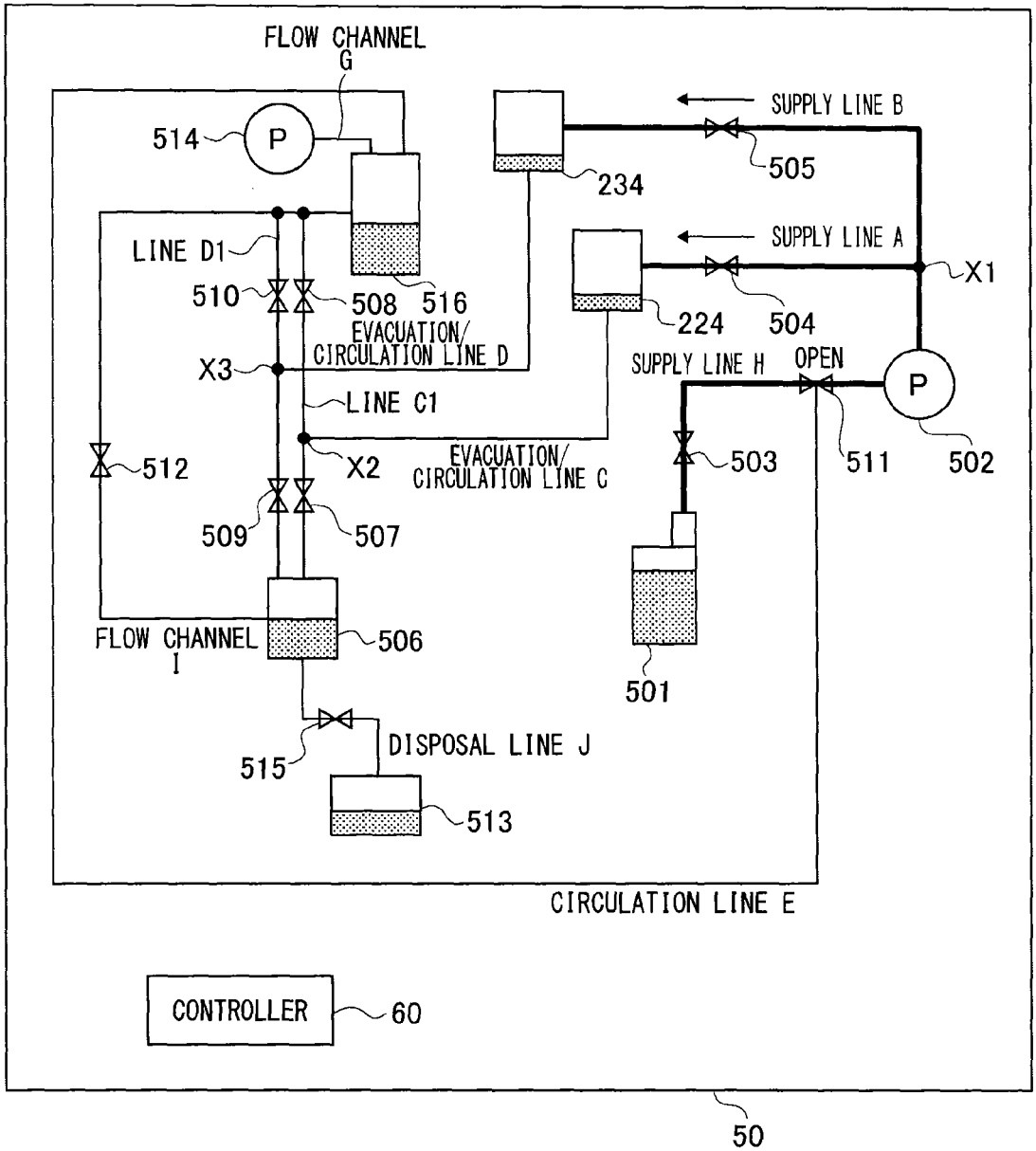
FIG. 8 is an explanatory view illustrating a flow of the pretreatment liquid when the pretreatment liquid is supplied to a supply pan from a cartridge.
Figure 9:
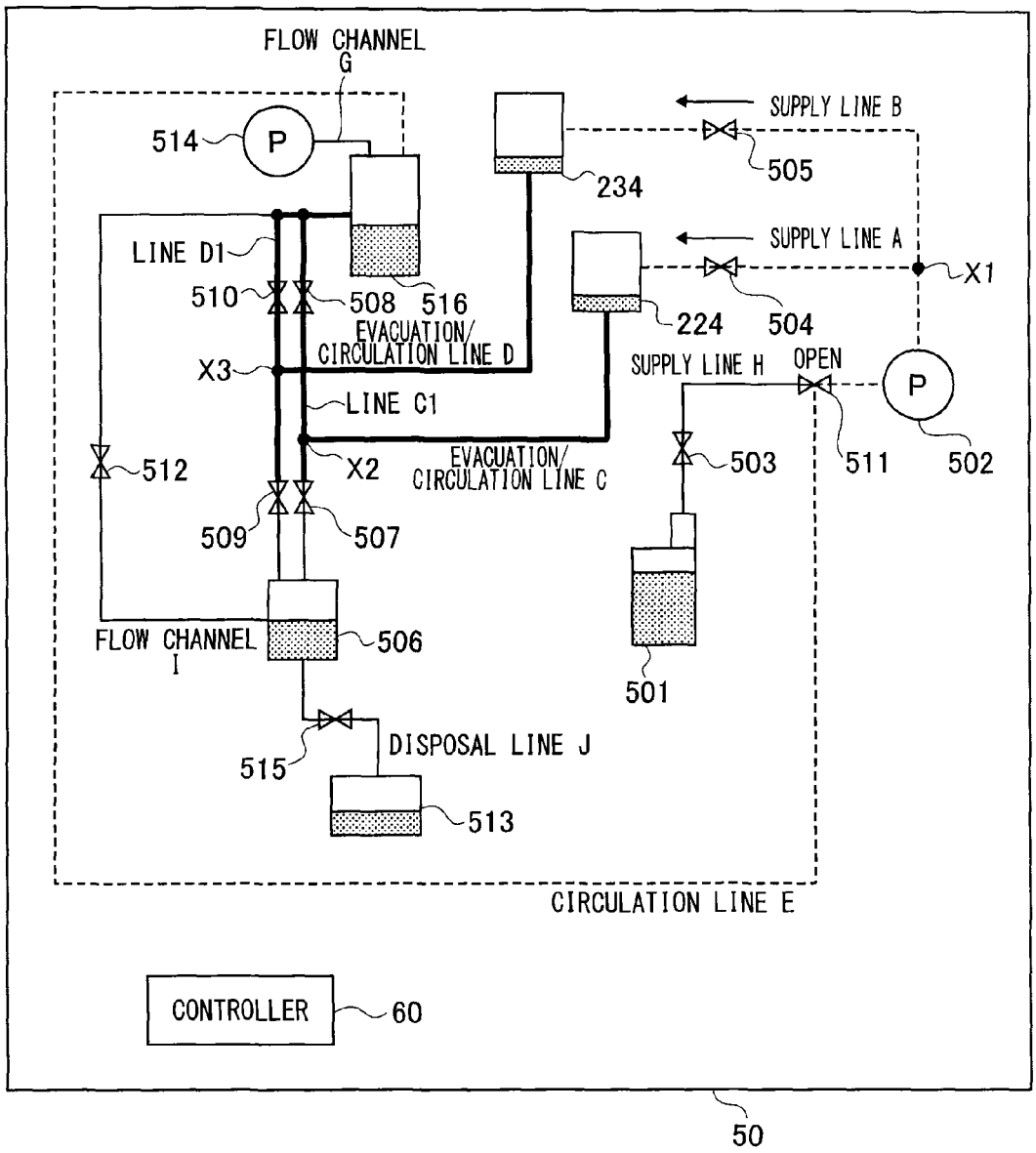
FIG. 9 is an explanatory view illustrating a flow of the pretreatment liquid when an evacuation and circulation line is previously filled with the pretreatment liquid.
Figure 10:
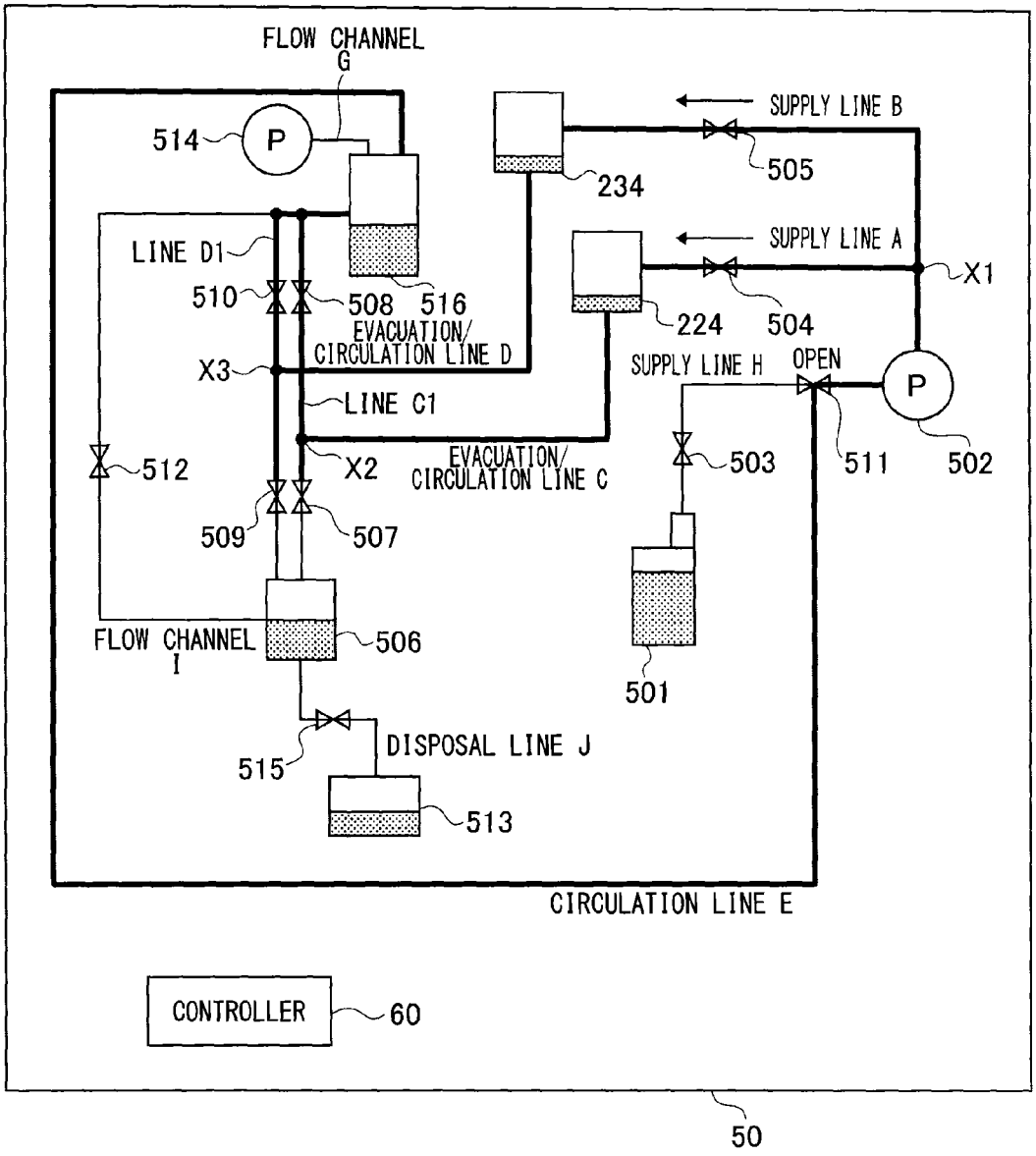
FIG. 10 is an explanatory view illustrating a flow of the pretreatment liquid when the pretreatment liquid is supplied to the supply pan through the circulation path.
Figure 11:
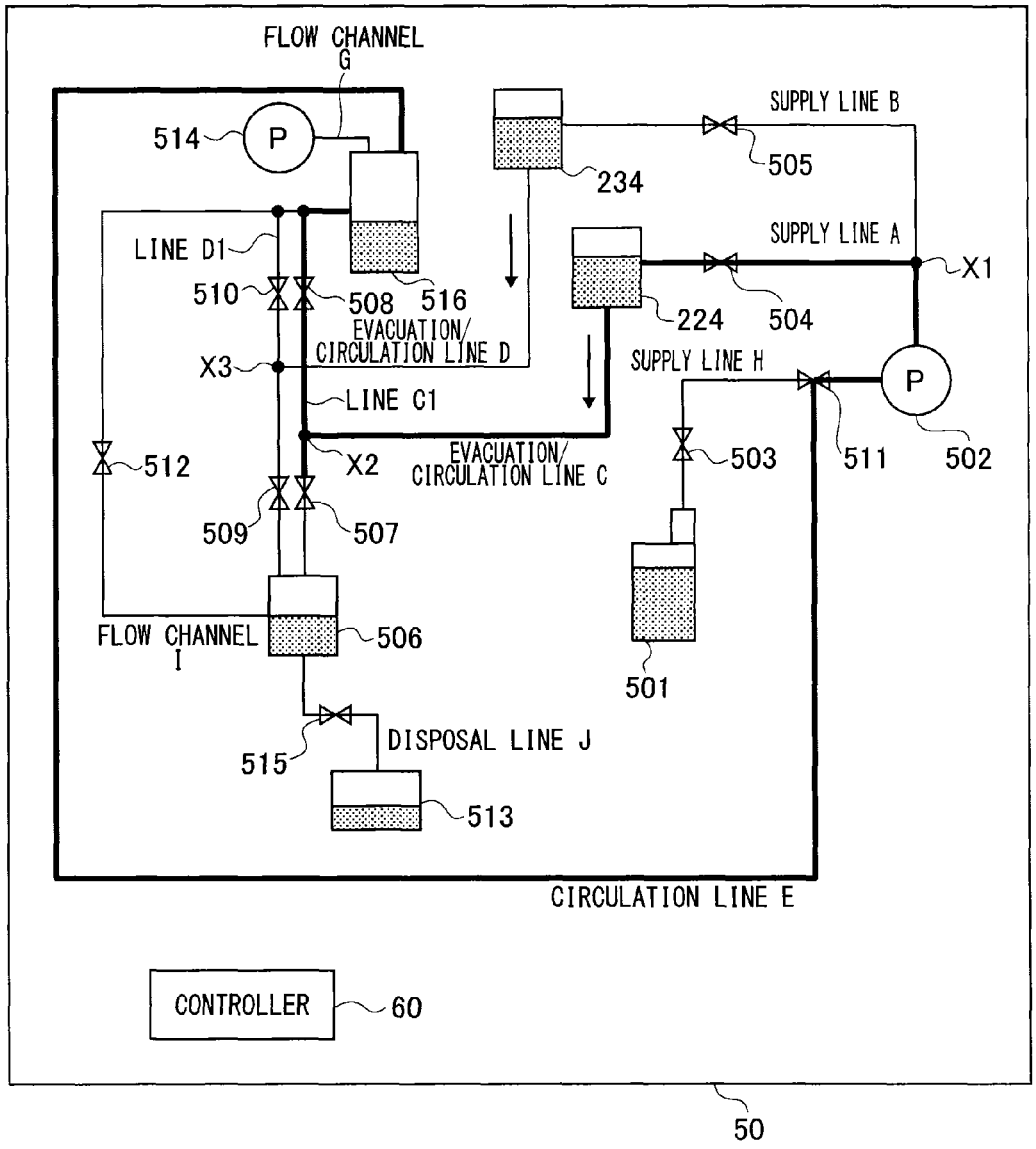
FIG. 11 is an explanatory view illustrating a flow of the pretreatment liquid when an evacuation and circulation path C is filled with the pretreatment liquid through the circulation path.
Figure 12:
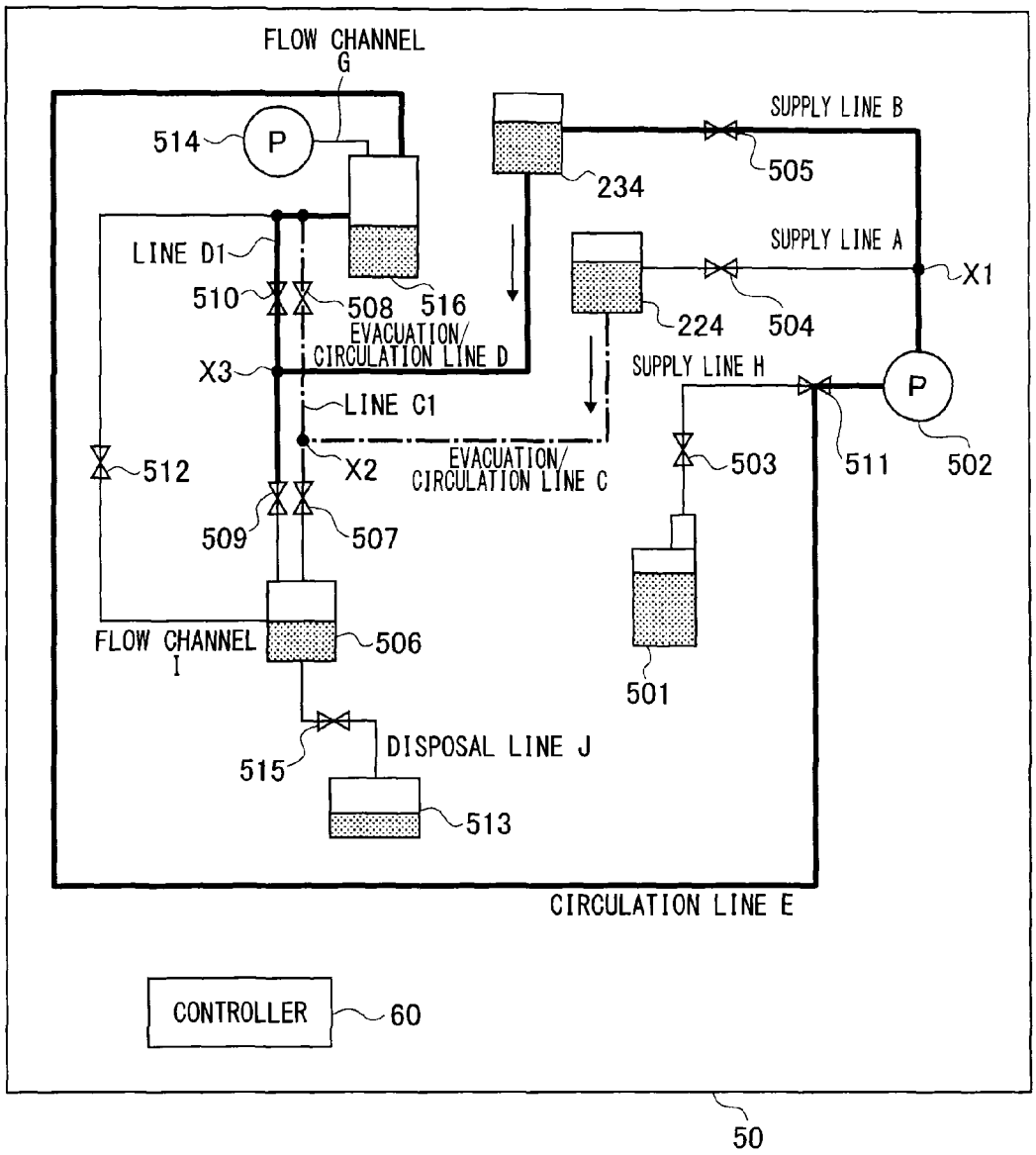
FIG. 12 is an explanatory view illustrating a flow of the pretreatment liquid when an evacuation and circulation path D is filled with the pretreatment liquid through the circulation path.
Figure 13:
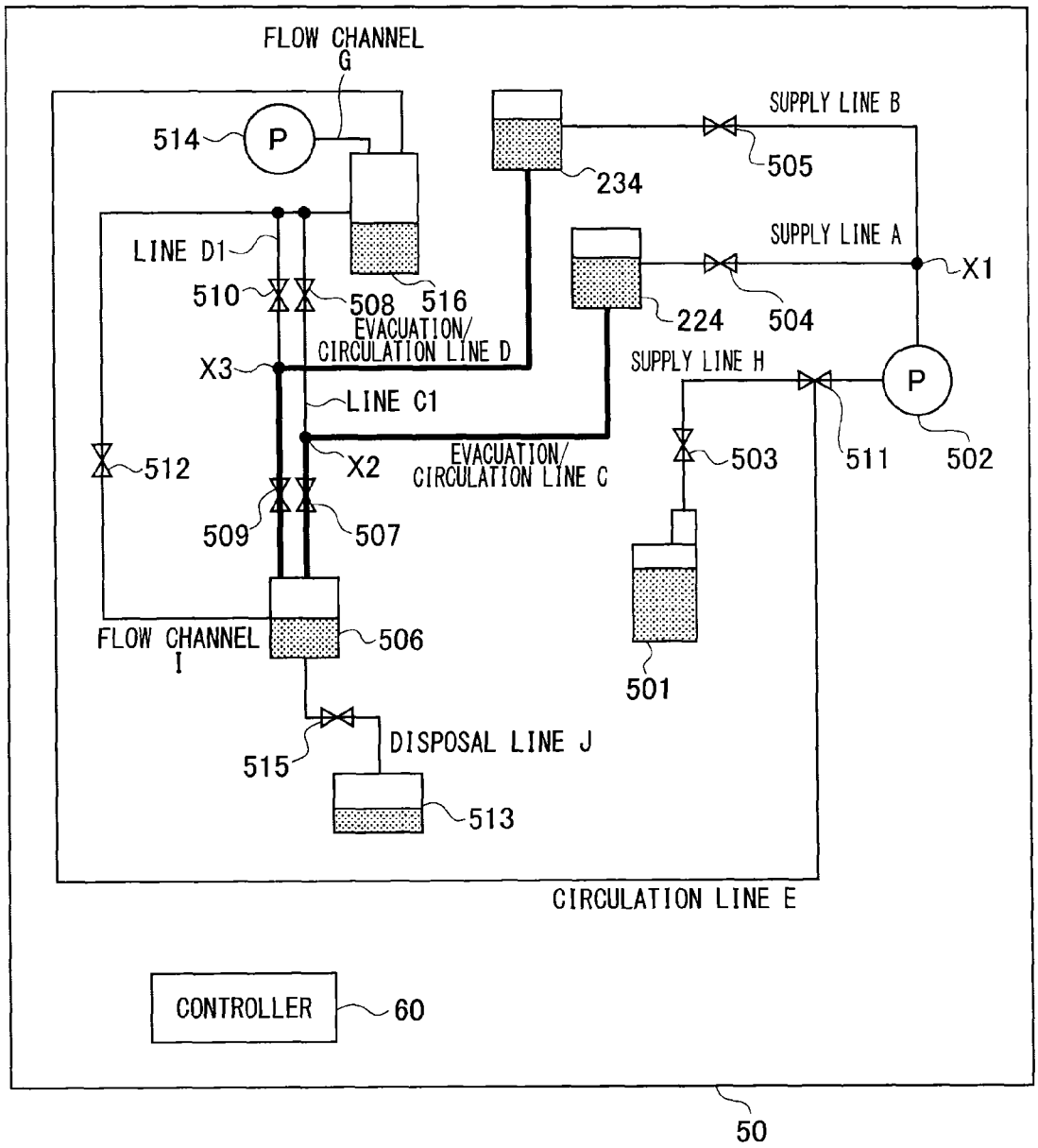
FIG. 13 is an explanatory view illustrating a flow of the pretreatment liquid during evacuation.

Hereinafter, the processing operation of the pretreatment device including the liquid-supply apparatus 50 according to Embodiment and the evacuation operation of the liquid-supply apparatus 50 will be described in detail with reference to FIG. 7 to FIG. 13. FIG. 7 is a flow chart illustrating the processing flow of the pretreatment device including the liquid-supply apparatus 50 according to Embodiment. FIG. 8 is an explanatory view illustrating the flow of the pretreatment liquid upon supplying the pretreatment liquid from the cartridge to the supply pan. FIG. 9 is an explanatory view illustrating the flow of the pretreatment liquid when the evacuation and circulation line is preliminary filled. FIG. 10 is an explanatory view illustrating the flow of the pretreatment liquid when the pretreatment liquid is supplied to the supply pan through the circulation line. FIG. 11 is an explanatory view illustrating the flow of the pretreatment liquid when the evacuation and circulation line C is filled through the circulation line. FIG. 12 is an explanatory view illustrating the flow of the pretreatment liquid when the evacuation and circulation line D is filled through the circulation line. FIG. 13 is an explanatory view illustrating the flow of the pretreatment liquid during an evacuation operation. Hereinafter, a description will be made according to each step in FIG. 7 in order.

The supplying processor 603 determines first whether or not it is the timing for supplying the pretreatment liquid to the supply pans 224 and 234 (S701). The supplying processor 603 determines that it is the timing for supplying when the liquid-supply apparatus 50 (or pretreatment device 2) is powered on, or when the application operation is started after the pretreatment liquid filled in the supply pans 224 and 234 is transferred to the reserve tank 506. When the supplying timing is not determined (S701/No), a stand-by state is maintained until the supplying timing.

When the supplying timing is detected (S701/Yes), and when application mode information indicating that the application should be performed to which surface of the upper-side, back-side, or both-sides is sent to the pretreatment device 2 from the image-forming apparatus 3 (S702/Yes), the supplying processor 603 identifies the device (one of or both upper-side surface application device 22 and back-side surface application device 23) which applies the pretreatment liquid to the application surface indicated by the application mode information, and supplies the pretreatment liquid to the supply pan of the application device only (S703).

When the pretreatment device 2 does not obtain the application mode information (S702/No), the supplying process of the pretreatment liquid is started on both supply pans 224 and 234 of the upper-side surface application device 22 and the back-side surface application device 23 (S704).

In the step S703 and step S704, the supplying processor 603 determines the remaining amount based on the detection signal from the remaining-amount sensor in the reserve tank 506. When the remaining amount is insufficient, the controlling command is sent to the opening and closing valve controller 604 in order to open the supply lines H, A, and B for supplying the pretreatment liquid in the cartridge 501 to the supply pans 224 and 234.

As shown in FIG. 8, during the liquid supply operation to the supply pans 224 and 234 therefore, the opening and closing valve controller 604 opens the electromagnetic valve 503 on the supply line H connecting the cartridge 501 and the liquid-delivery pump 502, the electromagnetic valve (three-way valve) 511, the electromagnetic valve 504 on the supply line A connected to the supply pan 224, and the electromagnetic valve 505 on the supply line B connected to the supply pan 234. The opening and closing valve controller 604 opens the supply lines H, A and B connecting the cartridge 501 and each supply pan 224 and 234. Then, the pretreatment liquid is supplied from the cartridge 501 to the supply pans 224 and 234 by driving the liquid-delivery pump 502 through the liquid delivery pump controller 607.

When the remaining amount in the reserve tank 506 is sufficient, the controlling command is sent to the opening and closing valve controller 604 so as to open the circulation lines I and E arranged in order to supply the pretreatment liquid in the reserve tank 506 instead of that in the cartridge 501 to the supply pans 224 and 234, and to open the supply lines H, A, and B.

The step S703 and the step S704 can be omitted and the process may skip to the step S705 when the remaining amount is sufficient. Information in which the filling is performed from which one of the reserve tank 506 and the cartridge 501 is temporary stored in a memory. Such information will be used in the next step.

The electromagnetic valves 507, 508, 509, and 510 are closed while the supplying operation of the pretreatment liquid to the supply pans 224 and 234 is performed in the step S703 and the step S704. When the pretreatment liquid flows from the cartridge 501 to the supply pans 224 and 234, the flowing amount of the pretreatment liquid into the evacuation and circulation lines is small because of the air remained in the evacuation and circulation lines C and D, although there is a little amount of the pretreatment liquid flowing into the circulation lines C and D. Therefore, the evacuation and circulation lines C and D are not filled with the pretreatment liquid in the step S703 and the step S704.

In such a case, when the supply pans 224 and 234 are filled with the pretreatment liquid from the cartridge 501, the auxiliary-operation determination portion 601 determines that the evacuation and circulation lines C and D are not yet filled with the pretreatment liquid (S705/No), and the process moves to the step S706.

The auxiliary-operation determination portion 601 determines whether or not it is the timing for filling the evacuation and circulation lines C and D (S706). The timing for filling is, for example, after a time T1 has passed from the time in which the filling operation to the supply pans 224 and 234 in the step S703 and the step S704 is started. It is appropriate that the time T1 corresponds to the time in which the pretreatment liquid is filled in the supply pans 224 and 234 of the upper-side surface application device 22 and the back-side surface application device 23 at the amount for filling the evacuation and circulation lines C and D. When the liquid surface of the pretreatment liquid inside the supply pans 224 and 234 in the upper-side surface application device 22 and the back-side surface application device 23 is equal to or higher than the detection threshold in the LOW level liquid surface detection sensor, the filling operation to the evacuation and circulation lines C and D can be started immediately without waiting for the elapse of the time T1.

When the auxiliary-operation determination portion 601 does not determines the timing for filling (S706/No), the process returns to the step S705, and stands by until the timing for filling the evacuation and circulation lines C and D comes.

When the auxiliary-operation determination portion 601 detects the timing for filling (S706/Yes), the filling portion 605 sends the opening and closing operation command for the electromagnetic valve arranged in order for filling the evacuation and circulation lines C and D to the opening and closing valve controller 604 (S707).

The filling process to the evacuation and circulation lines C and D in the step S707 will be described with reference to FIG. 9. In FIG. 9, the bold line represents the flow of the pretreatment liquid, and the dotted line represents a negative-pressure section. As shown in FIG. 9, when the evacuation and circulation lines C and D are filled, the electromagnetic valves 507 and 509 on the evacuation and circulation lines C and D are closed, the electromagnetic valves 508 and 510 on the lines C1 and D1 are opened, and the electromagnetic valve (three-way valve) 511 is closed so that the circulation line E connecting the liquid-delivery pump 502 and the filtering chamber 516 opens. Under such a condition, when the liquid-delivery pump 502 is driven for a predetermined time T2, the air in the filtering chamber 516 is sucked by the force of the liquid-delivery pump 502. Thus, the inside of the filtering chamber 516 becomes a negative pressure, and the force to suck the pretreatment liquid from the supply pan 224 into the filtering chamber 516 functions. Therefore the pretreatment liquid is forcibly sent and filled in the ductwork of the evacuation and circulation lines C and D from each supply pan 224 and 234. It is appropriate herein that the time T2 corresponds to the time for filling the pretreatment liquid in the evacuation and circulation lines C and D at the essential amount through the force of liquid-delivery pump 502 (liquid-flow generator). However, there may be a case in which the driving time of time T2 cannot be ensured because the starting of the application operation in the upper-side surface application device 22 and the back-side surface application device 23 is prioritized. In such instance, the filling operation to the evacuation and circulation lines C and D is not perfectly completed. However, the later described auxiliary operation (step S712 and step S713) can fill the evacuation and circulation lines C and D with the pretreatment liquid completely just before the evacuation operation so as to increase the flowing speed of the pretreatment liquid during the evacuation operation.

After the filling operation to the evacuation and circulation lines C and D, the information regarding the completion of filling of the evacuation and circulation line is stored in the memory, and the process moves to the step S708.

The supplying processor 603 determines whether or not the supplying operation to the supply pans 224 and 234 is completed. When the operation is not completed (S708/No), the process returns to the step S702, and the supplying operation to the supply pans 224 and 234 is continued. When the completion of the operation is determined (S708/Yes), the process moves to the step S709.

The upper-side surface evacuation line and the back-side surface evacuation line are filled by circulating the pretreatment liquid during the application operation when the application is operated normally by the upper-side surface application device 22 and the back-side surface application device 23. However, there may be a case in which the evacuation timing is reached before the execution of the application operation. For example, the evacuation timing is reached when the liquid-supply operation to the supply pans 224 and 234 is performed frequently, and the circulating operation may be unnecessary before the start of the application operation. The evacuation timing is also reached when the signal of starting the application operation is sent, but the printing operation is not started immediately. It is important in the present Embodiment that the upper-side surface evacuation line and the back-side evacuation line are filled prior to the evacuation operation so as to achieve the reduction of the time of the liquid-evacuation operation.

Hereinafter, a description regarding a case in which the application operation and the circulation operation are performed will be made with reference to FIG. 10. Then, an operation filling the upper-side surface evacuation line and the back-side evacuation line when the circulation operation is not performed will be described.

The circulation process will be described with reference to FIG. 10. As shown in FIG. 10, the electromagnetic valves 507 and 509 on the evacuation and circulation lines C and D are closed, and the electromagnetic valves 508 and 510 on the lines C1 and D1 are opened when the pretreatment liquid is circulated during the application operation. The circulation line E connecting the liquid-delivery pump 502 and the filtering chamber 516 is opened by closing the electromagnetic valve 512 on the flow channel I and by opening the electromagnetic valve (three-way valve) 511. In addition, the electromagnetic valves 504 and 505 on the supply lines A and B are opened. When the liquid-delivery pump 502 is driven for a predetermined time T3 under such a condition, the air inside the filtering chamber 516 is sucked through the force of the liquid-delivery pump 502 and the inside of the filtering chamber 516 becomes a negative pressure. Thus, the force for sucking the pretreatment liquid from the supply pans 224 and 234 through the evacuation and circulation lines C and D into the filtering chamber 516 functions. Because the inside of the circulation line E also becomes a negative pressure, the pretreatment liquid after the filtering process flows into the circulation line E, and flows into the supply pans 224 and 234 through the liquid-delivery pump 502. As shown in FIG. 10, when the circulation process is performed normally during the application operation, the evacuation and circulation lines C and D are filled with the liquid. Thereby the immediate transfer to the evacuation operation can be performed.

On the other hand, when the circulation operation is not performed, the evacuation and circulation lines C and D are not filled with the liquid. Herein, the filling operation is executed according to each step after the step S709 in order.

The evacuation-operation determination portion 602 determines whether or not it is the evacuation timing. That is, the evacuation-operation determination portion 602 determines whether or not to transfer the pretreatment liquid inside the supply pan to the reserve tank 506 (S709). Generally, when the application operation is not performed continuously for about from 30 minutes to two hours, the evacuation operation is performed. Similarly, the evacuation operation is performed upon changing the application device. When the evacuation-operation determination portion 602 determines to perform the evacuation operation (S709/Yes), it is determined whether or not the remaining amount of the pretreatment liquid in the supply pan as the object of the evacuation operation is sufficient. When the remaining amount is insufficient (S710/No), the supplying process of the pretreatment liquid is performed to the supply pan (S711). Because the supplying process herein is similar to those in the step S703 and the step S704, the repetitive description is omitted herein.

When the evacuation-operation determination portion 602 determines not to perform the evacuation operation (S709/No), the process stands by until the evacuation timing comes.

The filling portion 605 performs the filling operation to the evacuation and circulation line C as an auxiliary operation upon the evacuation operation of the upper-side surface application device 22 (S712). The auxiliary operation upon evacuation of the upper-side surface application device will be described with reference to FIG. 11.

As shown in FIG. 11, the electromagnetic valve 507 on the evacuation and circulation line C is closed, and the electromagnetic valve 508 on the line C1 is opened during the evacuation process of the upper-side surface application device 22. The electromagnetic valves 509, 510, and 512 are also closed. When the liquid-delivery pump 502 is driven for the predetermined time T3 under such a condition, the air in the filtering chamber 516 is sucked by the force of the liquid-delivery pump 502, and the inside of the filtering chamber becomes a negative pressure. Thus, the force for sucking the pretreatment liquid from the supply pan 224 into the filtering chamber 516 functions. Thereby, the evacuation and circulation line C is filled.

Next, the filling portion 605 performs the filling operation to the evacuation and circulation line C as the auxiliary operation upon the evacuation operation of the back-side surface application device 23 (S713). The auxiliary operation upon the evacuation operation of the back-side surface application device will be described with reference to FIG. 12.

As shown in FIG. 12, the electromagnetic valve 509 on the evacuation and circulation line D is closed, and the electromagnetic valve 510 is opened so as to open the evacuation and circulation line D during the evacuation process. Herein, the evacuation and circulation line C is already filled (shown by the dashed-dotted line in FIG. 12). When the liquid-delivery pump 502 is driven for a predetermined time T4 under such a condition, the air inside the filtering chamber 516 is sucked by the power of the liquid-delivery pump 502, and the inside of the filtering chamber becomes negative pressure. Thus, a force for sucking the pretreatment liquid from the supply pan 234 into the filtering chamber 516 functions. Thereby, the evacuation and circulation line D is filled.

The order of the above-described step S712 and step S713 can be switched. Because there is a water-head difference between the supply pan 224 of the upper-side surface application device 22 and the supply pan 234 of the back-side surface application device 23, and by starting one of the step S712 and the step S713 after finishing the other of two, the filling operation to the application device which locates in a relative lower position can be prevented from being inhibited by the filling operation to the application device located in a relative higher position. Thus, the entire time required for the filling operation can be reduced, and the evacuation and circulation line can be completely filled with the pretreatment liquid. When one of the upper-side surface application device 22 and the back-side surface application device 23 is selected as the object of the supplying operation in the step S703, the filling operation can be performed only for the selected application device.

The evacuation processor 606 sends a command to the opening and closing valve controller 604 so as to open the electromagnetic valves 507 and 508. The evacuation and circulation lines C and D are opened by the opening operation of the electromagnetic valves performed by the opening and closing valve controller 604. Thereby, the pretreatment liquid is flown into the reserve tank 506 from the supply pans 224 and 234 by the water-head difference as shown in FIG. 13, and thereby, the evacuation operation is performed (S714).

According to Embodiment, when the pretreatment liquid is evacuated from the liquid application device by the water-head difference, the air resistance during the pretreatment liquid passes through the evacuation line is reduced and the flowing speed of the pretreatment liquid is accelerated by preliminary filling each evacuation line with the pretreatment liquid. Thus, the time until the evacuation operation is completed can be shortened. In particular, the time until the evacuation operation is completed can be shortened by preliminary filling each evacuation line with the pretreatment liquid when the pretreatment liquid is evacuated from the two liquid application devices by the water-head difference. In addition, because the opening of the electromagnetic valve for starting the evacuation operation is performed at the same time, the total time required for the evacuation operation becomes shorter than that in the case in which the evacuation operation is performed sequentially. Thereby, the reduction of the stand-by time of the operator upon changing the application device can be particularly achieved.

According to Embodiment, the liquid-supply apparatus in which the time reduction of the evacuation operation of the liquid from the liquid-supply pan storing the liquid which is used for the application operation to the recording medium can be achieved, and the image-forming system including the liquid-supply apparatus can be provided.

Although the embodiments of the present invention have been described above, the present invention is not limited thereto. It should be appreciated that variations may be made in the embodiments described by persons skilled in the art without departing from the scope of the present invention.

What is claimed is:

1. A liquid supply apparatus which supplies liquid to be applied onto a recording medium to a liquid supply pan storing the liquid, the liquid supply apparatus comprising:

a temporary storage room arranged in a position lower than a liquid surface of the liquid supply pan, the temporary storage room to receive the liquid inside the liquid supply pan by evacuation using a water-head difference between the temporary storage room and the liquid supply pan;

an evacuation line connecting the liquid supply pan and the temporary storage room, the evacuation line being a flow channel for the liquid during evacuation;

an evacuation line valve to open and close the evacuation line; and a controller controlling an opening and closing operation of the evacuation line valve, wherein the liquid surface in the temporary storage room is disposed in a position lower than a position of the liquid supply pan, and the controller controls:

the opening and closing operation of the evacuation line valve and a driven device so as to fill the evacuation line with the liquid using a negative pressure created by the driven device as an auxiliary operation just before the evacuation using the water-head difference; and the opening and the closing operation of the evacuation line valve to effect the evacuation using the water-head difference, wherein the driven device is also configured to fill the liquid supply pan.

2. The liquid supply apparatus according to claim 1 further comprising:

circuitry to determine whether or not to evacuate the liquid from the liquid supply pan and a liquid-application device to apply the liquid to the recording medium, the circuitry determining to evacuate the liquid when a stopping time of an application operation of the liquid application device is longer than a predetermined threshold time, when detachment of the liquid supply pan is instructed, when a change of an image formation output state to the recording medium is instructed, or when an exchange of the recording medium is instructed.

3. The liquid supply apparatus according to claim 1 further comprising:

a filtering chamber to perform a filtering process to remove foreign matter contained in the liquid;

a line used for the filtering process, the line diverging from the evacuation line and connecting to the filtering chamber; and a circulation line to supply the liquid after the filtering process from the filtering chamber to the liquid supply pan, wherein the driven device is to generate a flow of the liquid after the filtering process, the flow being from the filtering chamber to a liquid-application device in the circulation line, and the driven device is driven for a time required for filling the evacuation line with the liquid in the auxiliary operation.

4. The liquid supply apparatus according to claim 1, wherein the liquid supply pan comprises an upper-side surface supply pan storing the liquid to be applied onto an upper-side surface of the recording medium and a back-side surface supply pan storing the liquid to be applied onto a back-side surface of the recording medium, the evacuation line comprises an upper-side surface evacuation line connecting the upper-side surface supply pan and the temporary storage room and a back-side evacuation line connecting the back-side surface supply pan and the temporary storage room, the evacuation line valve comprises an upper-side surface evacuation line valve opening and closing the upper-side surface evacuation line and a back-side surface evacuation line valve opening and closing the back-side surface evacuation line, and the controller controls an opening and closing operation of the upper-side surface evacuation line valve and the back-side evacuation line valve so as to start filling of one of the upper-side surface evacuation line and the back-side surface evacuation line after completing filling of the other evacuation line in the auxiliary operation.

5. An image forming system comprising:

the liquid supply apparatus according to claim 1;

a liquid application device comprising the liquid supply pan, the liquid application device applying the liquid onto the recording medium, and an image forming apparatus performing image-formation output to the recording medium onto which the liquid is applied by the liquid-application device.

6. The liquid supply apparatus according to claim 1, wherein:

the driven device comprises a pump.

7. The liquid supply apparatus according to claim 1, wherein the evacuation line valve comprises:

a first valve which opens and closes a path from the evacuation line to a filter chamber; and a second valve which opens and closes a path from the evacuation line to the temporary storage room.

* * * * *